US007055554B2

(12) United States Patent
Fujitani

(10) Patent No.: US 7,055,554 B2
(45) Date of Patent: Jun. 6, 2006

(54) METHOD FOR CONTROLLING WEFT INSERTION IN AIR JET TYPE LOOM

(75) Inventor: Mutsuo Fujitani, Kanazawa (JP)

(73) Assignee: Tsudakoma Kogyo Kabushiki Kaisha, Kanazawa (JP)

( * ) Notice: Subject to any disclaimer, the term of this patent is extended or adjusted under 35 U.S.C. 154(b) by 204 days.

(21) Appl. No.: 10/442,142

(22) Filed: May 21, 2003

(65) Prior Publication Data

US 2004/0011419 A1 Jan. 22, 2004

(30) Foreign Application Priority Data

Jul. 22, 2002 (JP) ..... 2002-212296

(51) Int. Cl.
*D03D 47/30* (2006.01)

(52) U.S. Cl. ..... 139/435.2

(58) Field of Classification Search ..... 139/435.1, 139/452; 700/140, 130
See application file for complete search history.

(56) References Cited

U.S. PATENT DOCUMENTS 4,827,990 A 5/1989 Takegawa
4,967,806 A * 11/1990 Imamura et al. ..... 139/435.1
5,115,840 A * 5/1992 Yamada ..... 139/435.2
2002/0026962 A1 3/2002 Banba et al.

FOREIGN PATENT DOCUMENTS

| | | | |
|---|---|---|---|
| EP | 0 306 998 | A | 3/1989 |
| EP | 0 414 211 | A | 2/1991 |
| JP | 62-257439 | A | 11/1987 |
| JP | 2618376 | B | 3/1997 |
| JP | 10-96140 | A | 10/1998 |

* cited by examiner

*Primary Examiner*—John J. Calvert
*Assistant Examiner*—Andrew W. Sutton
(74) *Attorney, Agent, or Firm*—Smith Patent Office

(57) ABSTRACT

A method for controlling weft insertion in an air jet type loom, includes setting an upper limit and a lower limit with respect to the running property of a weft yarn to be inserted through a shed of warp yarns by way of a main nozzle and a plurality of groups of sub nozzles arrayed in the running direction of the weft yarn, and causing air jet end timings of the respective groups of sub nozzles to become later when the running property of a weft yarn is lower than the lower limit, and air jet start timings of the respective groups of sub nozzles to become sooner when the running property of a weft yarn is higher than the upper limit. This method enables stable weaving of high-quality fabric while minimizing air consumption by properly regulating both the air jet start timing and the air jet end timing of sub nozzles of the air jet type loom, considering variation in the running property of a weft yarn.

4 Claims, 8 Drawing Sheets

METHOD FOR CONTROLLING WEFT INSERTION IN AIR JET TYPE LOOM

BACKGROUND OF THE INVENTION

1. Field of the Invention

This invention relates to a method for controlling weft insertion in an air jet type loom that enables to minimize air consumption required for weft insertion.

2. Description of the Related Art

Air jet type looms are generally operated in such a manner that weft yarn is jetted out through a main nozzle together with air jetted out from a plurality of sub nozzles disposed downstream of the main nozzle in the running direction or path of weft yarn and is inserted to a shed of warp yarn.

Generally, sub nozzles are divided into a plurality of groups arrayed along the running path of weft yarn. Air is jetted out from each group of sub nozzles in a relay manner one after another from upstream side toward downstream side of the running direction of weft yarn by appropriately setting the timing and duration of jetting air with respect to each group of sub nozzles. Thus, weft yarn is securely inserted every time picking operation (weft insertion) is performed without loosening the weft yarn. In other words, each group of sub nozzles jets air in the weft inserting direction toward a tip end of the running weft yarn to help smooth running of the weft yarn.

Running properties of weft yarn are not constant in the length direction of weft yarn. In view of this, there is proposed a technique of properly regulating the air jet timing and air jet duration of sub nozzles depending on the running properties of weft yarn (e.g., see Japanese Unexamined Patent Publication No. 10-310951). Specifically, this publication proposes delaying the air jet end timing of the sub nozzles to thereby extend the air jet duration of the sub nozzles, and advancing the air jet start timing of sub nozzles in transient periods such as immediately after start-up of the loom or replacing time of a weft supplying body of supplying weft yarn when the running properties of weft yarn are lowered, considering a phenomenon that apparent or actual running properties of weft yarn are temporarily improved during these transient periods.

In the aforementioned prior art, however, since the air jet start timing of the sub nozzles is advanced merely during the transient periods, the prior art does not provide any contribution to improvement on running properties of weft yarn resulting from factors other than the aforementioned phenomenon seen in the transient periods. The prior art encountered problems such as loosening of weft yarn due to undesirable lowering of running speed of weft yarn and deterioration of quality of fabric resulting from such loosening of weft yarn. If the air jet start timing of the sub nozzles is set well in advance prior to a reference timing in an attempt to avoid such a drawback, air consumption is excessively large, which is uneconomical in the aspect of production cost of fabric.

SUMMARY OF THE INVENTION

It is an object of the present invention to provide a method for controlling weft insertion in an air jet type loom that is free from the problems residing in the prior art.

It is another object of the present invention to provide a method for controlling weft insertion in an air jet type loom that enables to stably perform weaving of high-quality fabric while minimizing air consumption by properly regulating both the air jet start timing and the air jet end timing of sub nozzles of the air jet type loom, considering variation of running properties of weft yarn.

According to an aspect of the invention, an upper limit and a lower limit are set with respect to running property of a weft yarn to be inserted through a shed of warp yarns by way of a main nozzle and a plurality of groups of sub nozzles arrayed in the running direction of the weft yarn. Air jet end timings of predetermined groups of sub nozzles are controlled to become later when the running property of a weft yarn is lower than the lower limit, and air jet start timings of predetermined groups of sub nozzles are controlled to become sooner when the running property of a weft yarn is higher than the upper limit.

In the case where the running property of a weft yarn is lower than the lower limit, the air jet end timings of the predetermined groups of sub nozzles are delayed. In the case where the running property of a weft yarn is higher than the upper limit, the air jet start timings are advanced. In this way, even if the running property of a weft yarn is varied during weaving operation of the loom, stable weft insertion is secured without excessively extending the air jet durations of the predetermined groups of sub nozzles, and high-quality fabric is stably woven while minimizing the air consumption.

These and other objects, features and advantages of the present invention will become more apparent upon a reading of the following detailed description and accompanying drawing.

DESCRIPTION OF THE PREFERRED EMBODIMENTS

Figure 1:
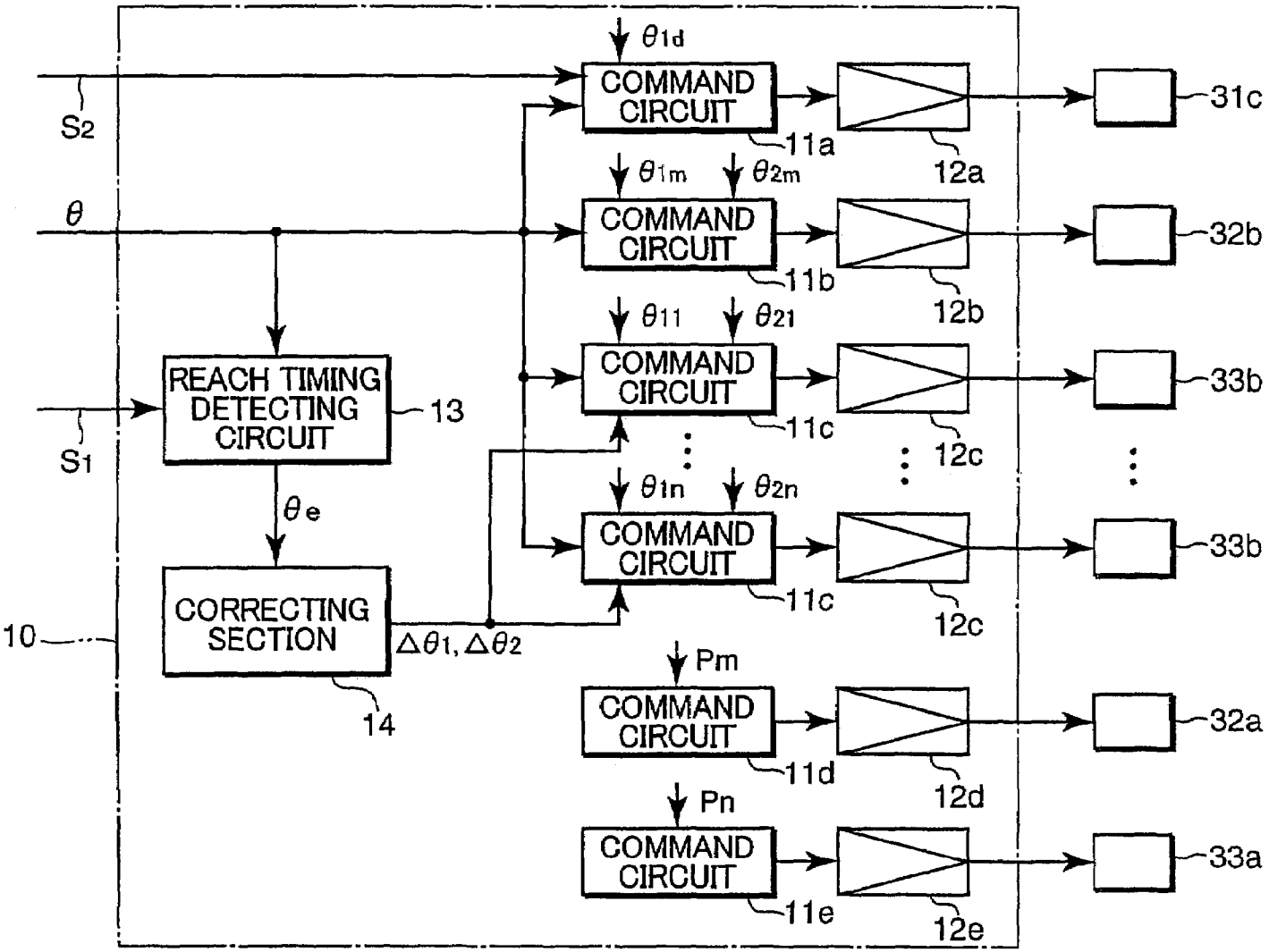
FIG. 1 is a block diagram showing an entire configuration of a weft insertion controlling device for use in an air jet type loom in accordance with an embodiment of the invention.

Referring to FIGS. 1 through 6 showing a preferred embodiment of the invention, a weft insertion controlling device 10 for implementing a weft insertion control in an air jet type loom comprises, as shown in FIG. 1, plural command circuits 11*a* to 11*e*, plural drive circuits 12*a* to 12*e* provided in correspondence with the respective command circuits 11, a weft arrival timing detecting circuit 13, and a correcting section 14.

The air jet type loom is equipped with a weft measuring and storing apparatus 31 in the form of a drum, a main nozzle 32, and a plurality of sub nozzles 33 which are divided into a certain number of groups and are arrayed downstream of the main nozzle 32 in the running direction of weft yarn. It should be noted hereinafter that the side (left-side in FIG. 2) corresponding to the upstream side of the running direction of weft yarn is referred to as "weft-in side", and the side (right-side in FIG. 2) opposite to the weft-in side is referred to as "weft-out side". The weft measuring and storing apparatus 31 winds up weft yarn Y fed from a yarn supplying body Ya around a drum main body 31*b* of the apparatus 31 by way of a rotary yarn guide 31*a* for temporarily storing the weft yarn, and unwinds or releases the weft yarn Y from the drum main body 31*b* by the length corresponding to one insertion operation or picking operation at a predetermined weft insertion timing by operation of an engaging pin 31*c* which is controllably moved toward and away from the surface of the drum main body 31*b* for weft insertion. The main nozzle 32 jets air to insert the weft yarn Y fed from the weft measuring and storing apparatus 31 into a shed W of warp yarn at one picking operation. The plurality of groups of sub nozzles 33 which are arrayed in the running direction of the weft yarn Y group by group in a relay manner to thereby aid running of the weft yarn Y. Air is supplied to the main nozzle 32 from an air source 34 by way of a regulator 32*a* and an electromagnetic valve or solenoid valve 32*b*. Air is supplied from the air source 34 to each group of sub nozzles 33 by way of a corresponding regulator 33*a* and a corresponding solenoid valve 33*b*.

The sub nozzles 33 are divided into n groups (n is an integer) from upstream of the main nozzle 32 toward the weft-out side in such a manner that the first group of sub nozzles 33 is located at the most upstream side. Weft yarn Y which is inserted in the shed W of warp yarn is pressingly moved toward a cloth fell WF by a reed (not shown), and is cut by a cutter C disposed at the weft-in side of the loom. Thus, woven fabric WY is produced with the cloth fell WF located at a frontal end of the woven fabric.

The engaging pin 31*c*, the regulators 32*a*, 33*a*, and the solenoid valves 32*b*, 33*b* are individually connected with the weft insertion controlling device 10. The weft measuring and storing apparatus 31 is equipped with a release sensor 31*d* for counting the number of times of unwinding the weft yarn Y from the drum main body 31 of the apparatus 31. A release signal S2 is outputted from the release sensor 31 to the weft insertion controlling device 10. An encoder EN is directly connected with a main shaft A of the loom to detect a crank angle θ of the shaft A. Data on the crank angle θ from the encoder EN is inputted to the weft insertion controlling device 10 along with a yarn detecting signal S1 which is outputted from a weft feeler F disposed at the weft-out side of the loom.

When inputted to the weft insertion controlling device 10, data on the crank angle θ is branched out and inputted to the respective command circuits 11*a* to 11*c*, namely, an engaging-pin command circuit 11*a* for driving the engaging pin 31*c* of the weft measuring and storing apparatus 31, a main-nozzle command circuit 11*b* for driving the solenoid valve 32*b* of the main nozzle 32, and sub-nozzle command circuits 11*c* for driving the respective solenoid valves 33*b* of the groups of sub nozzles 33, as well as to the weft arrival timing detecting circuit 13 (see FIG. 1). The yarn detecting signal S1 is inputted to the weft arrival timing detecting circuit 13. Upon receiving the yarn detecting signal S1, the weft arrival timing detecting circuit 13 outputs to the correcting section 14 angle data θe (hereinafter, called as "reach timing data θe") indicating a weft arrival timing. The correcting section 14 is electrically connected with the sub-nozzle command circuits 11*c* and outputs correction data, which will be described later, to these sub-nozzle command circuits 11*c*.

Specifically, values θ1*m*, θ2*m* which respectively indicate the air jet start timing and the air jet end timing of the main nozzle 32 in terms of crank angle θ are inputted to the main-nozzle command circuit 11*b*. Values θ1n (n=1, 2, . . . ), θ2n (n=1, 2, . . . ) which respectively indicate the air jet start timing and the air jet end timing of each group of sub nozzles 33 in terms of crank angle θ are inputted to the corresponding one of the sub-nozzle command circuits 11*c*. Further, a release signal S2 from the release sensor 31*d* and a value θ1*d* indicating the weft insertion start timing in terms of crank angle θ are inputted to the engaging-pin command circuit 11*a*. It should be appreciated that each one of the command circuits 11*a* to 11*c* are operatively connected to one of the engaging 31*c*, the solenoid valve 32*b* of the main nozzle 32, the solenoid valves 33*b* of the groups of sub nozzles 33 via a corresponding drive circuit 12*a* to 12*c* depending on from which element the signal or data is outputted.

The weft insertion controlling device 10 is further incorporated with a main-regulator command circuit 11*d* for driving the regulator 32*a* of the main nozzle 32, a drive circuit 12*d* which is electrically connected with the main-regulater command circuit 11*d*, sub-regulator command circuits 11*e* for driving the respective regulators 33*a* of the groups of sub nozzles 33, and drive circuits 12*e* which are electrically connected with the respective corresponding sub-regulator command circuits 11*e*. In FIG. 1, only one set of the sub-regulator command circuit 11*e* and the corresponding drive circuit 12*e* is exemplarily shown for easier explanation. A value Pm for setting the pressure of jet air which is to be jetted out from the main nozzle 32 is outputted to the main-regulator command circuit 11*e*. Values Pn (n=1, 2, . . . ) for setting the pressures of jet air which are to be jetted out from the respective groups of sub nozzles 33 are outputted to the sub-regulator command circuits 11*e*.

Figure 3:
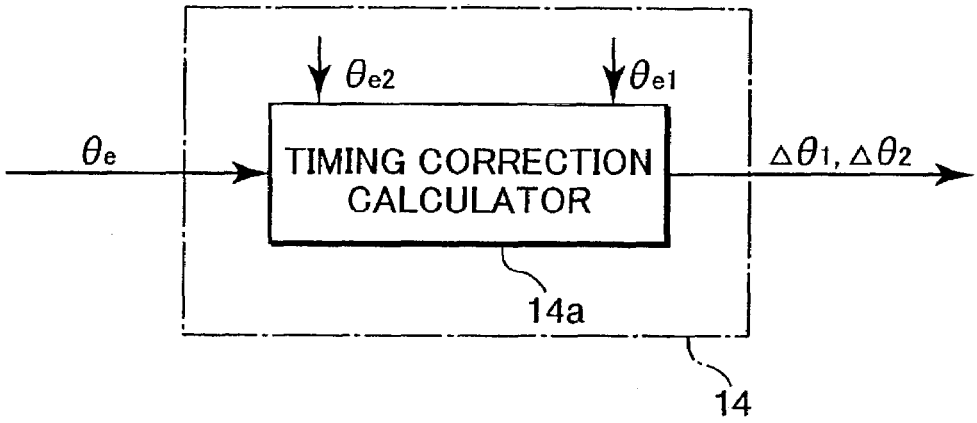
FIG. 3 is a block diagram showing a correcting section in the weft insertion controlling device.

As shown in FIG. 3, the correcting section 14 includes a timing correction calculator 14*a*. The reach timing data θe indicating the reach timing of weft yarn is outputted from the reach timing detecting circuit 13 to the timing correction calculator 14*a*. An upper limit θe1 and a lower limit θe2 of the reach timing data θe are inputted to the timing correction calculator 14*a*.

The crank angle θ detected by the encoder EN is inputted to the engaging-pin command circuit 11. When it is detected that θ=θ1*d* (namely, the crank angle data coincides with the weft insertion start timing data), the engaging pin 31*c* is moved away from the surface of the drum main body 31*b* in response to a drive signal from the corresponding drive circuit 12 to thereby release engagement of the weft yarn Y from the drum main body 31*b*. At θ=θ1*m*≈θ1*d*, the main-nozzle command circuit 11*b* outputs a command signal to the corresponding drive circuit 12*b* to energize and open the solenoid valve 32*b* to thereby activate the main nozzle 32. As timed with the activation of the main nozzle 32, the weft yarn Y is released from the drum main body 31*b* and is inserted to the shed W of the warp yarn.

Figure 4:
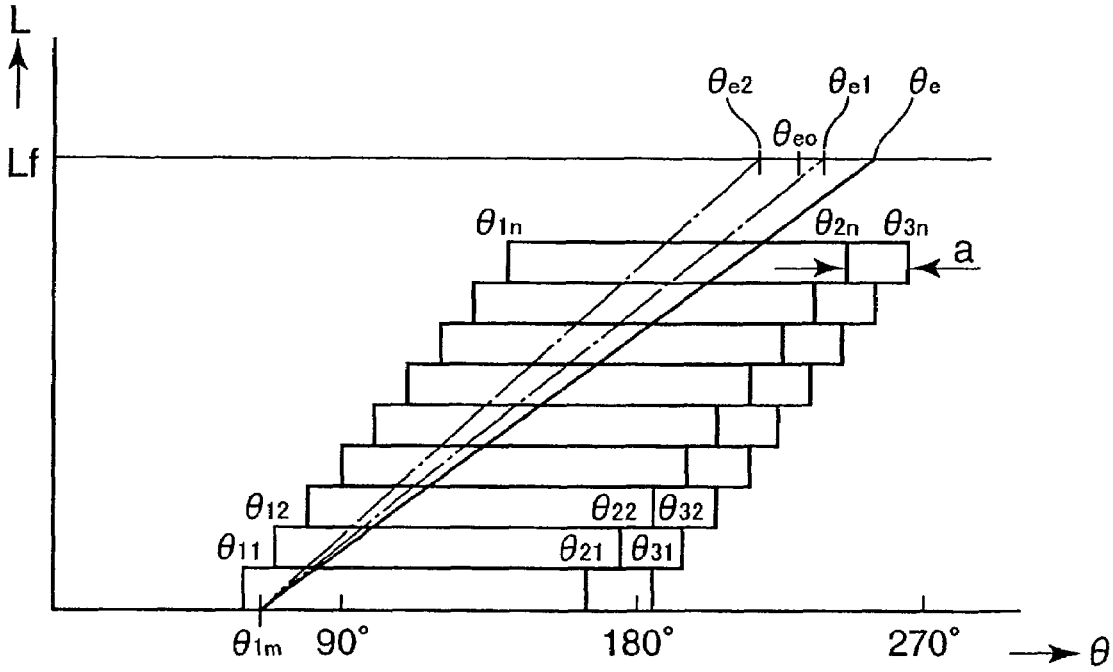
FIG. 4 is a chart showing control in the weft insertion controlling device in terms of a relation between crank angle and running distance of weft yarn in the case where running property of weft yarn is deteriorated.

On the other hand, at θ=θ11, θ12, . . . , θ1n, the sub-nozzle command circuits 11*c* output command signals to the respective corresponding drive circuits 12*c* to energize and open the respective corresponding solenoid valves 33*b* one after another group by group so as to allow the groups of sub nozzles 33 to jet air from upstream toward downstream in the running direction of the weft yarn Y in a relay manner (see FIG. 4). It should be noted that the horizontal axis of the chart shown in FIG. 4 denotes crank angle θ, and the vertical axis thereof denotes running distance L of weft yarn Y measured from a tip end of the main nozzle 32 to a downstream end of weft yarn Y in the running direction. Specifically, in FIG. 4, the air jet start timings θ11, θ12, . . . , θ1n of the respective groups of sub nozzles 33 are set at θ11<θ12< . . . <θ1n.

When the weft yarn Y is released from the drum main body 31*b* by the length corresponding to one picking operation, a release signal S2 is outputted from the release sensor 31*d* to the engaging-pin command circuit 11*a*, which in turn operatively moves the engaging pin 31*c* toward the drum main body 31*b* to engage the weft yarn Y. Concurrently, the sub-nozzle command circuits 11*c* operatively suspend operations of the respective corresponding groups of sub nozzles 33 one after another from upstream side by detecting θ=θ21, θ22, . . . , θ2n. Similar to the air jet start timings of the groups of sub nozzles 33, the air jet end timings θ21, θ22, . . . , θ2n are set such that θ21<θ22< . . . <θ2n. The main nozzle 32 suspends its operation when the main-nozzle command circuit 11*b* detects that θ=θ2*m*. The air jet pressure of the main nozzle 32, and the air jet pressures of the groups of sub nozzles 33 are set at Pm and Pn by way of the main-regulator command circuit 11*d* and the sub-regulator command circuits 11*e*, respectively.

When the weft yarn Y normally runs by the distance L=Lf, and is successfully inserted in the shed W of the warp yarn, the weft feeler F detects the tip end of the weft yarn Y and outputs a yarn detecting signal Si to the reach timing detecting circuit 13. The reach timing detecting circuit 13 then detects the weft yarn arrival timing data θe of the weft yarn Y by reading the crank angle θ at the time when the yarn detecting signal S1 has been generated, and outputs the detected reach timing data θe to the correcting section 14. In FIG. 4, the distance Lf denotes the distance of weft yarn Y from the tip end of the main nozzle 32 to the weft feeler F, and the oblique solid line denotes the running property of weft yarn Y at the time when the weft insertion was initiated at θ=θ1*m*. Also, in FIG. 4, the reach timing data θe of weft yarn Y, other target value θeo, the upper limit θe1 and the lower limit θe2 of the reach timing data θe are illustrated.

Figure 5A:
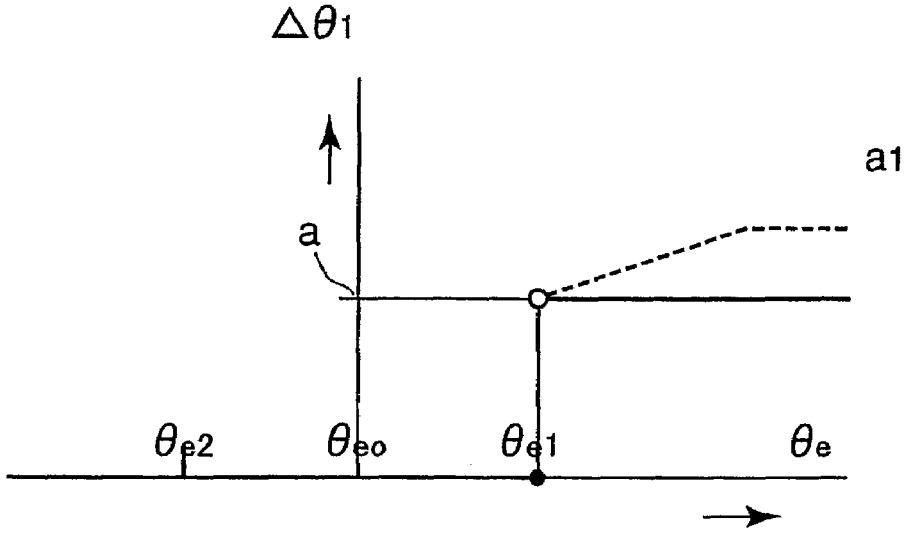
FIG. 5A is a graph showing a relation between weft arrival timing and correction amount for air jet end timing.
Figure 5B:
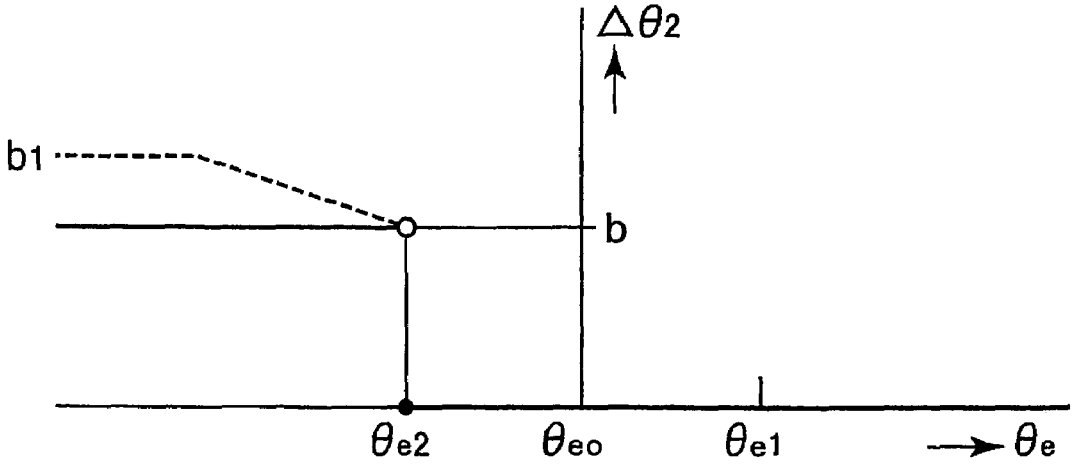
FIG. 5B is a graph showing a relation between weft arrival timing and correction amount for air jet start timing.

The timing correction calculator 14*a* of the correcting section 14 simultaneously outputs a correction amount Δθ1 for correcting the air jet end timing, and a correction amount Δθ2 for correcting the air jet start timing of each group of sub nozzles 33 to the sub-nozzle command circuits 11 by comparing the reach timing data θe outputted from the reach timing detecting circuit 13 with the upper limit θe1 and the lower limit θe2 thereof (see the respective solid lines in FIGS. 5A and 5B). It should be noted that the horizontal axis in FIGS. 5A and 5B denotes the reach timing data θe, and the vertical axis in FIG. 5A denotes the correction amount Δθ1, and the vertical axis in FIG. 5B denotes the correction amount Δθ2. Specifically, when θe2≦θe≦θe1, the correcting circuit 14 outputs the correction amounts: Δθ1=Δθ2=0.

When θe>θe1, the correcting circuit 14 outputs the correction amounts: Δθ1=a (a is a constant value), and Δθ2=0, respectively. When θe<θe2, the correcting circuit 14 outputs the correction amounts: Δθ1=0, Δθ2=b (b is a constant value).

In the above configuration, when the running property of weft yarn Y is deteriorated to such an extent that θe>θe1, as shown in the oblique solid line in FIG. 4, the sub-nozzle command circuits 11*c* are allowed to correctively set the air jet end timings θ2n of the respective groups of sub nozzles 33 at θ3n by implementing the equation: θ3n=θ2n+a. In other words, the sub-nozzle command circuits 11*c* can delay the air jet end timings of the respective groups of sub nozzles 33 from θ2n to θ3n=θ2n+a.

Figure 6:
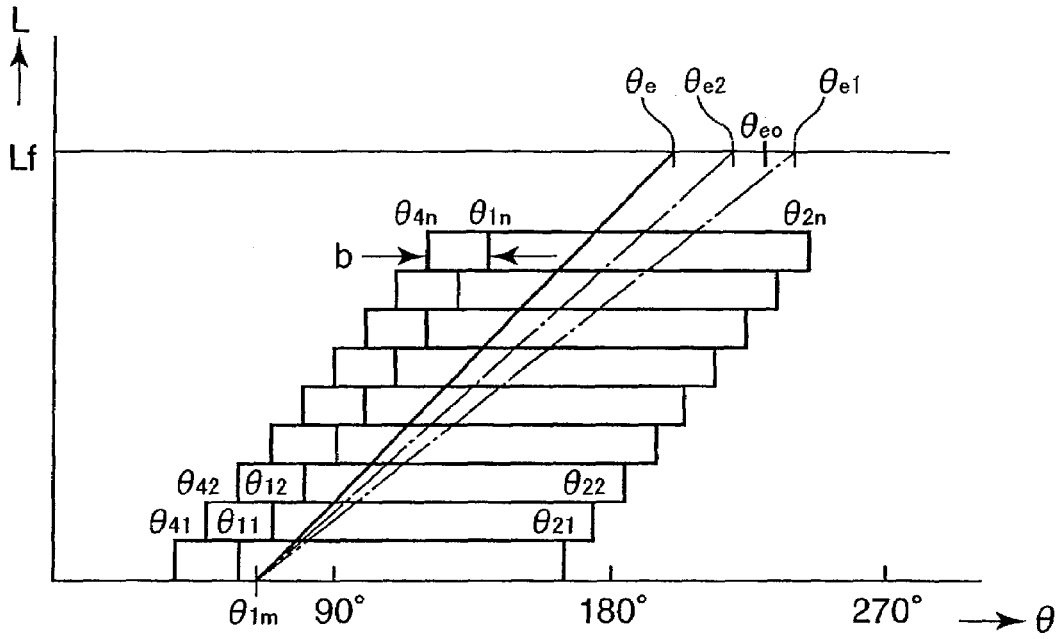
FIG. 6 is a chart showing control in the weft insertion controlling device in terms of a relation between crank angle and running distance of weft yarn in the case where running property of weft yarn is excessively improved.

On the contrary, in the case where the running property of weft yarn Y is excessively improved to such an extent that θe<θe2, as shown in the oblique solid line in FIG. 6, the sub-nozzle command circuits 11*c* are allowed to correctively set the air jet start timings θ1n of the respective groups of sub nozzles 33 at θ4n by implementing the equation: θ4n=θ1n−b. In other words, the sub-nozzle command circuits 11*c* can advance the air jet start timings of the respective groups of sub nozzles 33 from θ1n to θ4n=θ1n−b.

In the foregoing embodiment, alternatively, it may be possible to set Δθ1=f1(θe), Δθ2=f2(θe) when θe>θe1, θe<θe2, respectively, in place of setting Δθ1=a (a is a constant value), and Δθ2=b (b is a constant value). In the altered configuration, the correction amounts Δθ1, Δθ2 outputted from the correcting section 14 are respectively functions f1, f2 of the reach timing data θe having limits a1, b1 which are shown by the broken lines in FIGS. 5A and 5B.

In place of the configuration that the correction amounts Δθ1, Δθ2 are simultaneously outputted from the correcting section 14 to all the sub-nozzle command circuits 11*c*, it may be possible to output the correction amounts Δθ1, Δθ2 to the sub-nozzle command circuits 11*c* except the sub-nozzle command circuit 11*c* corresponding to at least the most upstream group of sub nozzles 33, or further alternatively, to the sub-nozzle command circuits 11*c* except one or more of the sub-nozzle command circuits 11*c*. Also, the correction amounts Δθ1, Δθ2 may be outputted to all or part of the sub-nozzle command circuits 11*c* by modifying the correction amounts Δθ1, Δθ2 as kn Δθ1, kn Δθ2, respectively, with respect to each sub-nozzle command circuit 11*c*. The modifying coefficients kn (n=1, 2, . . . ) for n groups of sub nozzles 33 are set such that k1≦k2 . . . ≦kn.

According to the embodiment, the weft feeler F serves to monitor whether weft yarn Y has been successfully inserted. Alternatively, a dedicated device may be provided to detect the reach timing data θe of weft yarn Y. Specifically, a dedicated filler F1 (see FIG. 2) may be provided at an appropriate position on the way of the running path of weft yarn Y, and a dedicated yarn detecting signal S3 outputted from the dedicated filler F1 may be used as the reach timing data θe in place of the yarn detecting signal S1 outputted from the weft feeler F to detect the weft insertion detection. Further alternatively, the release signal S2 from the release sensor 31*d* may be used for the weft insertion detection.

A proper averaging circuit may be provided between the reach timing detecting circuit 13 and the correcting circuit 14 in FIG. 1. The averaging circuit averages the reach timing data θe which have been accumulatively detected by implementing weft insertion operations a predetermined number of times, and outputs the result of averaging to the correcting section 14. With such an altered configuration, there is no likelihood that correction amounts Δθ1, Δθ2 outputted from the correcting section 14 are excessively varied. Further, the averaging circuit may compute a most adequate mode value by adopting a statistical technique such as moving averaging and weight averaging.

Figure 7:
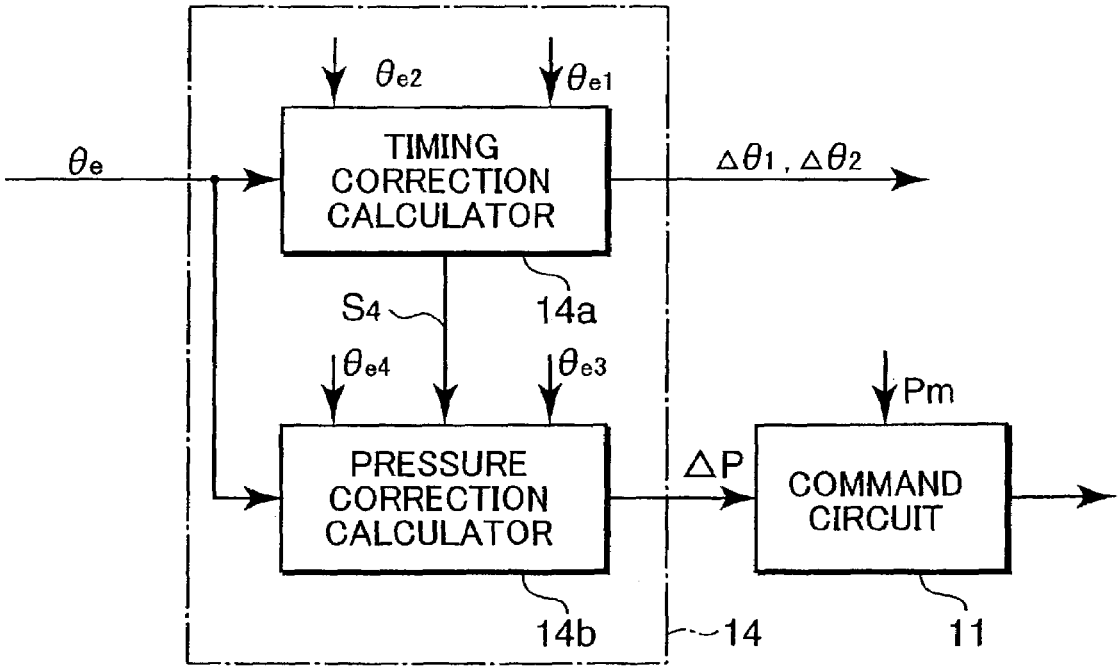
FIG. 7 is a block diagram showing a modification of the correcting section.

Now, a modified correcting section will be described with reference to FIGS. 7 through 10. As shown in FIG. 7, a correcting section 14 is provided with a pressure correction calculator 14*b* in addition to a timing correction calculator

14*a* An upper value θe3(>θe1) for setting an upper limit of air jet pressure of a main nozzle 32 and a lower value θe4(<θe2) for setting a lower limit of air jet pressure of the main nozzle 32 are inputted to the pressure correction calculator 14*b*. The upper limit θe3 and the lower limit θe4 are used for backup correction. Result of calculation in the pressure correction calculator 14*b* is outputted as a correction amount AP to a main-regulator command circuit 11*d*.

Figure 8:
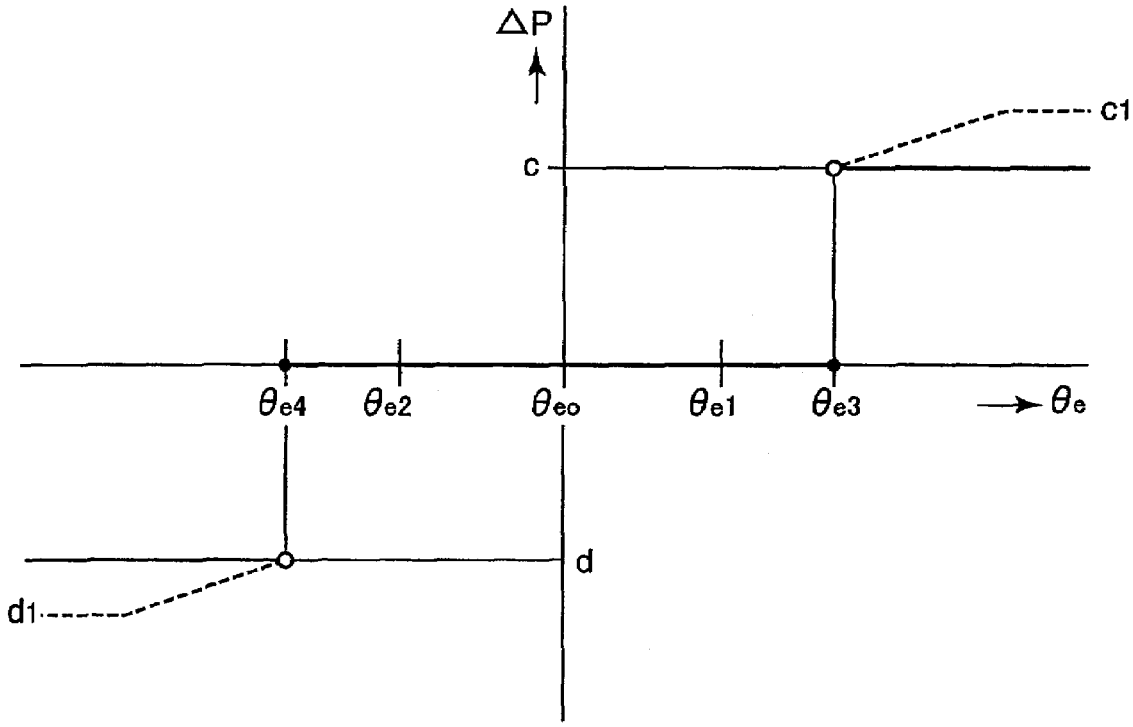
FIG. 8 is a chart showing control operation with use of a pressure correction calculator in the modification.

The pressure correction calculator 14*b* outputs the correction amounts ΔP=c (c is a constant value), ΔP=d (d is a constant value) when θe>θe3, θe<θe4, respectively, as shown by the solid lines in FIG. 8. When θe4≦θe≦θe3, ΔP=0. In this configuration, in response to receiving the correction amount ΔP from the correcting section 14, the main-regulator command circuit 11*d* is allowed to correctively set the air jet pressure of the main nozzle 32 at a value Pm+c, which is higher than the value Pm by the constant value c in the case where the running property of weft yarn Y is extremely deteriorated to such an extent that θe>θe3. On the other hand, in the case where the running property of weft yarn Y is extremely improved to such an extent that θe<θe4, the main-regulator command circuit 11 is allowed to correctively set the air jet pressure of the main nozzle 32 at a value Pm−d, which is lower than the value Pm by the constant value d. Alternatively, in place of outputting the correction amounts ΔP=c (c is a constant value, ΔP=d (d is a constant value), the pressure correction calculator 14*b* may output the correction amounts ΔP=g1(θe), g2(θe), as shown by the broken lines in FIG. 8. It should be noted that g1, g2 are functions of reach timing data θe having limit values c1, d1, respectively.

Normally, it is conceived that correction of air jet pressure of the main nozzle 32 by the correction amount ΔP outputted from the pressure correction calculator 14*b* does not provide such a high responsiveness as expected by correction of the air jet end timing and the air jet start timing of the groups of sub nozzles 33 by correction amounts Δθ1, Δθ2 outputted from the timing correction calculator 14*a*. In view of this, it is desirable not to reset the correction amount ΔP(≠0) outputted from the pressure correction calculator 14*b* at 0 (namely ΔP=0) as far as the timing correction calculator 14*a* does not detect that the weft arrival timing data θe lies in the range: θe2≦θe≦θe1. The above control operation of the pressure correction calculator 14*b* is implemented by outputting a reset signal S4 from the timing correction calculator 14*a* to the pressure correction calculator 14*b* (see FIG. 7). Alternatively, it may be possible to reset the respective correction amounts ΔP(≠0) corresponding to the cases where θe>θe3, θe<θe4 at 0 (ΔP=0) when it is detected that θe<θeo, θe>θeo, respectively, in place of the above arrangement in which the correction amount ΔP is reset at 0 upon receiving the reset signal S4 when it is detected that θe2≦θe≦θe1.

Alternatively, the correction amount ΔP from the pressure correction calculator 14*b* may also be outputted to sub-regulator command circuits 11 for driving respective regulators 33*a* of the groups of sub nozzles 33. In such an altered arrangement, the correction amount ΔP may be outputted to each of the sub-regulator command circuits 11 by modifying the correction amount ΔP to knΔP. It should be noted that kn (n=1, 2, . . . , n) are modification coefficients for the respective groups n of sub nozzles 33.

Alternatively, the operation of the timing correction calculator 14*a* may be implemented by a software program which is activated each time the weft arrival timing data θe is updated. An exemplary routine of the software program is shown in the flowchart of FIG. 9.

Figure 9:
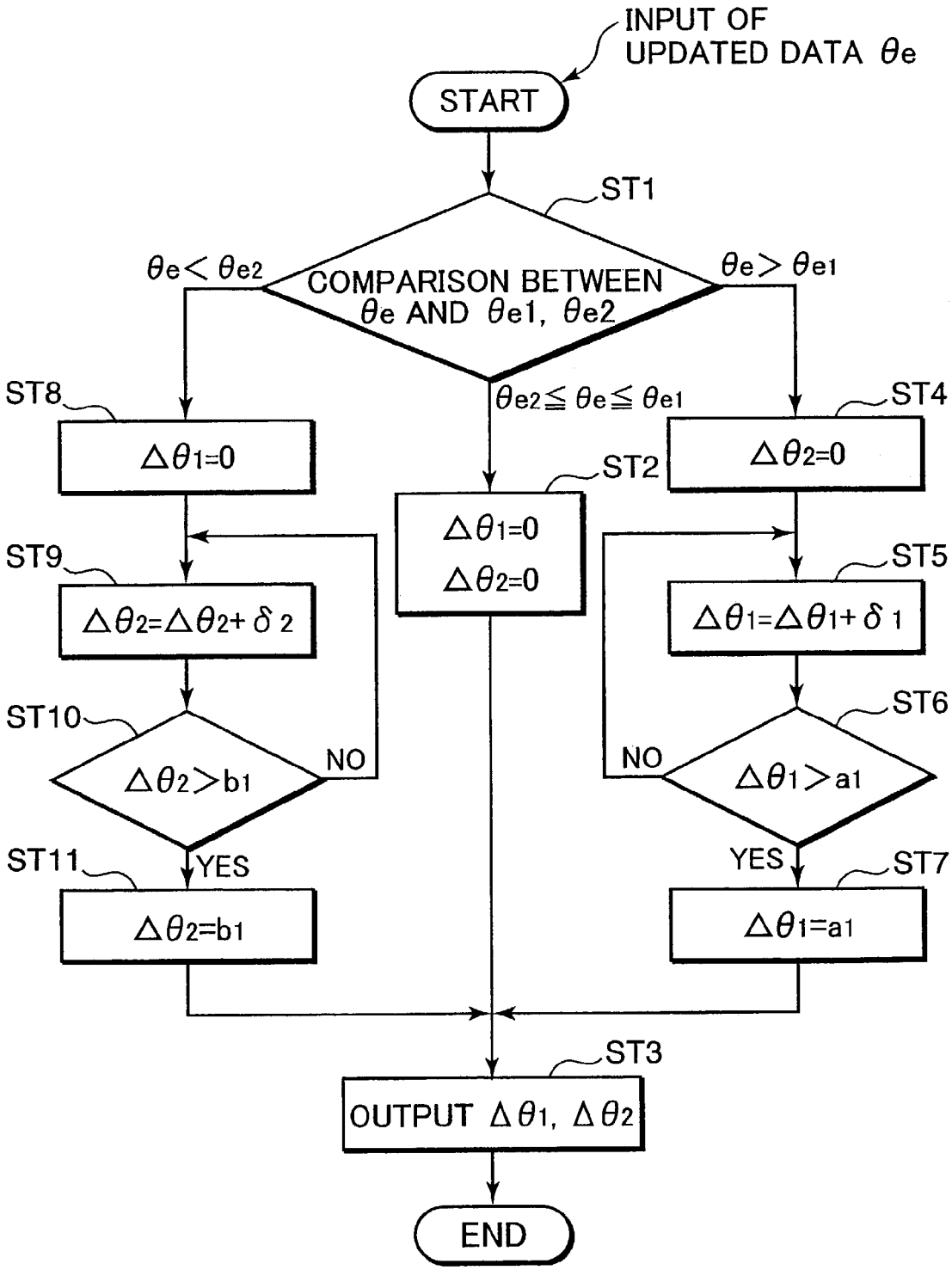
FIG. 9 is a flowchart showing a control procedure in the correcting section.

The software program is operated in accordance with the steps shown in FIG. 9. Step is referred to as ST such as ST1, ST2. First, comparison is made between the weft arrival timing data θe, and the upper limit θe1, the lower limit θe2 (ST1). If it is judged that θe2≦θe≦θe1, the correction amounts Δθ1, Δθ2 are set to Δθ1=Δθ2=0 (ST2), and are then outputted to the subnozzle command circuits 11*c* (ST3). Then, the routine ends.

On the other hand, if it is judged that θe>θe1 in ST1, the correction amount Δθ2 for correcting the air jet start timing is set at 0 (ST4), and the correction amount Δθ1 for correcting the air jet end timing is incremented by a certain amount δ1 until the correction amount Δθ1 becomes a1 (ST5 through ST7), and then, the correction amounts Δθ1, Δθ2 are outputted to the sub-nozzle command circuits 11*c* (ST3).

On the other hand, if it is judged that θe<θe2, the correction amount A θ1 for correcting the air jet end timing is set at 0 (ST8), and the correction amount Δθ2 for correcting the air jet start timing is incremented by a certain amount δ2 until the correction amount Δθ2 becomes b1 (ST9 through ST11), and then, the correction amounts Δθ1, Δθ2 are outputted to the sub-nozzle command circuits 11*c* (ST3).

In FIG. 9, the weft arrival timing data Oe is updated each time weft insertion (picking operation) is carried out. The weft arrival timing data θe is updated every several weft insertion operations by implementing e.g. averaging process. Further, it is possible to implement the operation of the pressure correction calculator 14*b* by a software program (not shown) in a similar manner as in FIG. 9.

Figure 10:
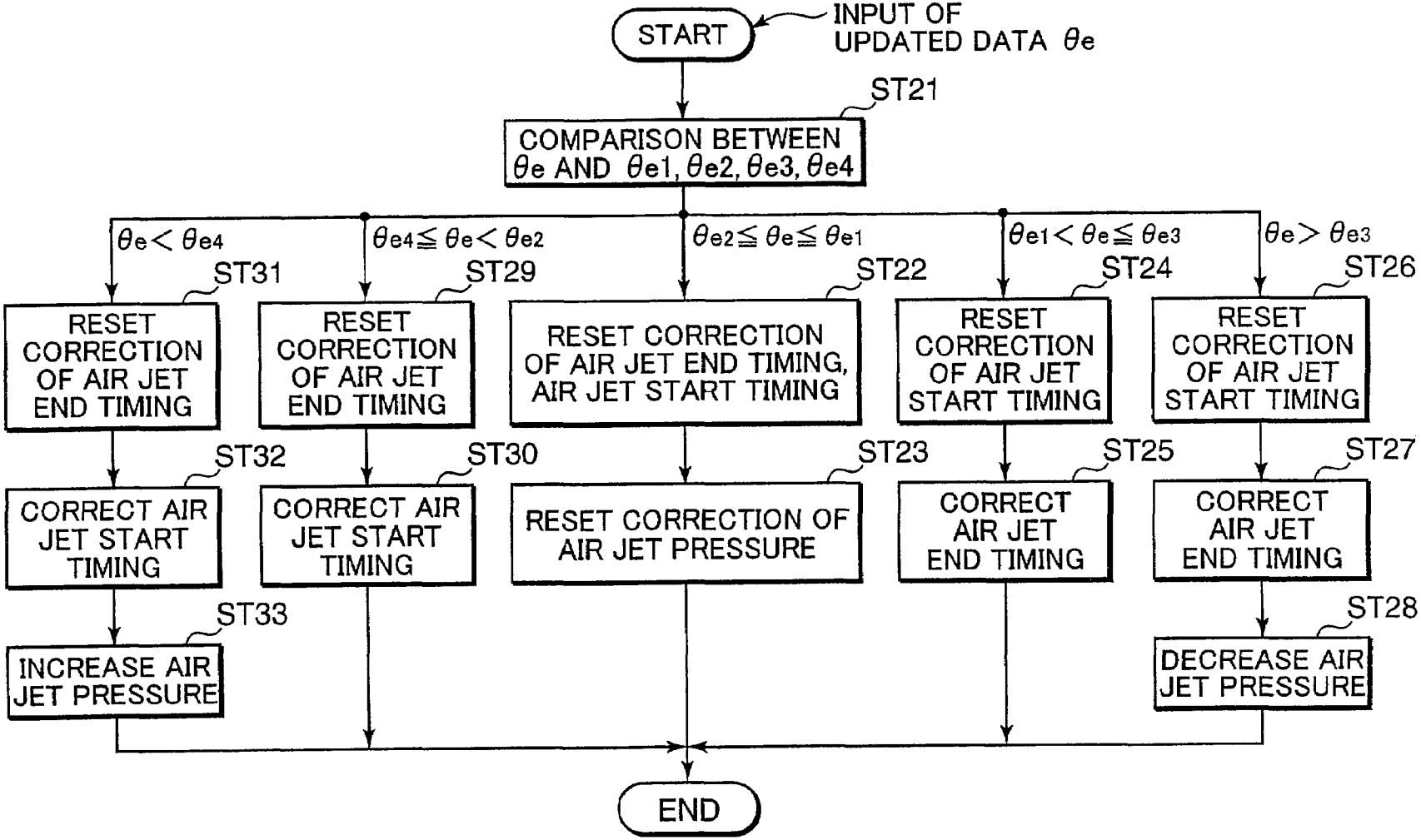
FIG. 10 is a flowchart showing a control procedure in the modified correcting section.

The operation of the correcting section 14 incorporating the timing correction calculator 14*a* and the pressure correction calculator 14*b* (see FIG. 7) is implemented by the program flowchart shown in FIG. 10. It should be appreciated that: ST22 in FIG. 10 corresponds to ST2 and ST3 in FIG. 9; ST24, ST26 in FIG. 10 correspond to ST4, ST3 in FIG. 9, respectively; ST29, ST31 in FIG. 9 correspond to ST8, ST3 in FIG. 9, respectively; ST25, and ST27 in FIG. 10 correspond to ST5 through ST7, and ST3 in FIG. 9, respectively; and ST30, and ST32 in FIG. 10 correspond to ST9 through ST11, and ST3 in FIG. 9, respectively. ST23, ST28, and ST33 in FIG. 10 are operations of the pressure correction calculator 14*b*.

According to the program flowchart shown in FIG. 10, the timing correction calculator 14*a* and the pressure correction calculator 14*b* shown in FIG. 7 are operable based on an instantaneous value and an average value of the weft arrival timing data θe, respectively. For instance, the backup upper limit θe3 and the backup lower limit θe4(<θe3) which are inputted to the pressure correction calculator 14*b* are set such that θe2<θe3<θe1, θe2<θe4<θe1, respectively. The timing correction calculator 14*a* outputs the correction amounts Δθ1 for the air jet end timing, Δθ2 for the air jet start timing each time weft insertion is implemented. This arrangement provides improved responsiveness of the loom. The pressure correction calculator 14*b* outputs the correction amount ΔP for correcting the air jet pressure of the main nozzle 32 in such a manner that the average value of the weft arrival timing data θe which have been accumulatively detected by implementing weft insertion operations a predetermined number of times lies within the range between the backup lower limit θe4 and the backup upper limit θe3. This arrangement enables to optimally cope with both a temporary variation and a long-term variation of the weft arrival timing data θe.

Alternatively, as mentioned above, it may be possible to provide a proper averaging circuit before the correcting section 14, and make the timing correction calculator 14*a* and the pressure correction calculator 14*b* operate based an average value of the weft arrival timing data θe. Further alternatively, the pressure correction calculator 14*b* may be so configured as to make the average value of the weft arrival timing data θe closer to the target value θeo by judging whether the weft arrival timing data θe is greater or smaller than the target value θeo.

Figure 2:
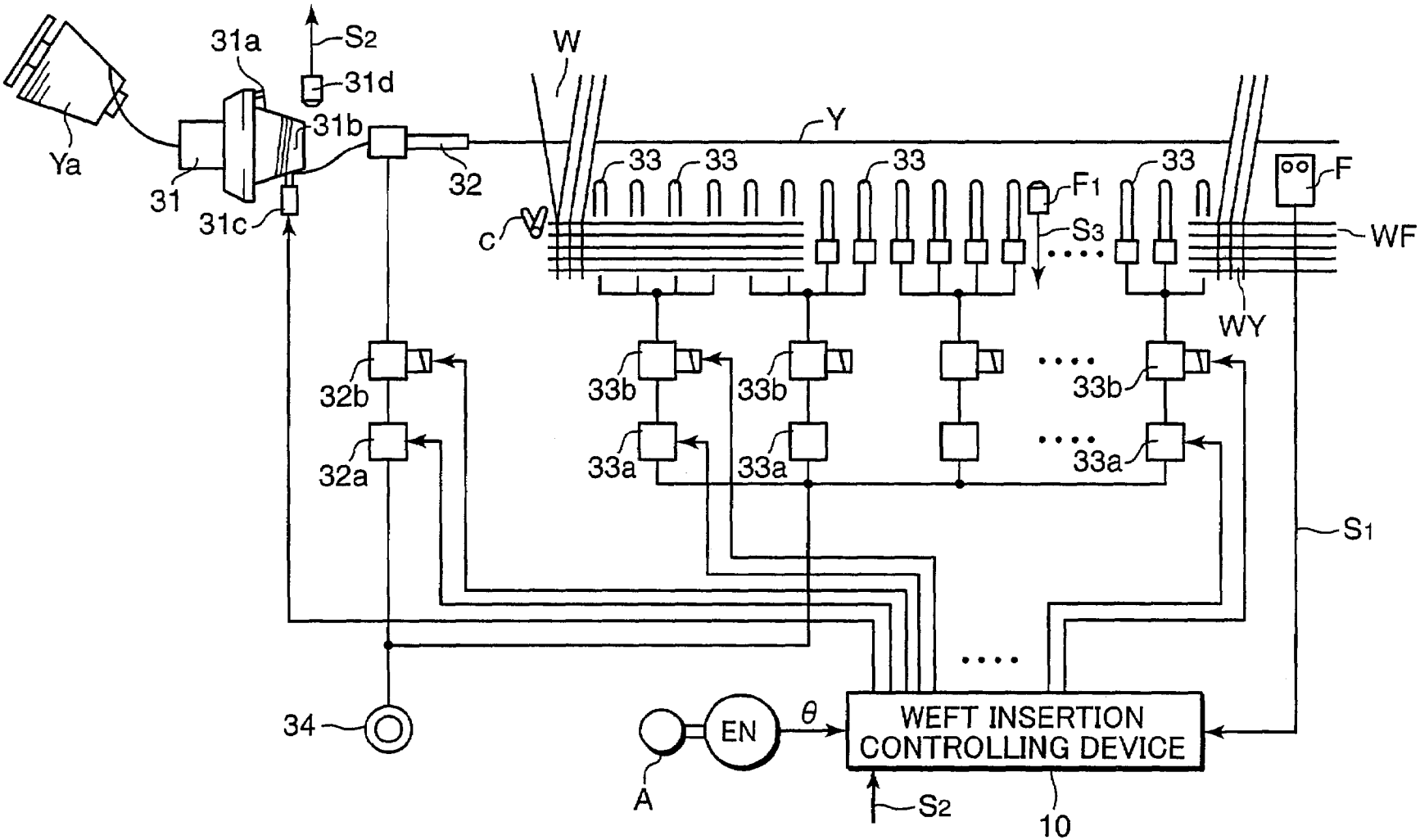
FIG. 2 is a diagram showing essential parts of the air jet type loom.

In the foregoing embodiments, as shown in FIGS. 1 and 2, the regulators 33*a* are provided with respect to each group of sub nozzles 33. Alternatively, the regulator 33*a* may be provided with respect to each two or more groups of sub nozzles 33. Further alternatively, a single regulator 33*a* may be provided for common use by all the groups of sub nozzles 33. In the altered arrangements, it is desirable to provide the sub-regulator command circuit 11*e* in correspondence to the regulator 33*a*.

The regulator 33*a* may be manually operated. Further, the sub-regulator command circuits 11*e* may be omitted. In the altered arrangement where the sub-regulator command circuits 11*e* are omitted, the pressure correction calculator 14*b* in the correcting circuit 14 is omitted.

Alternatively, the value θ1*m* for setting the air jet start timing of the main nozzle 32 and the value θ1*d* for setting the weft insertion start timing by way of the engaging pin 31*c* may be used in combination for controlling the weft insertion start timing so as to attain the weft arrival timing data Oe coincides with the target value θeo (θe=θeo). Further, the invention is optimally applicable to a multi-color air jet type loom by individually setting the upper limit θe1, the lower limit θe2, the backup upper limit θe3, the backup lower limit θe4 which are inputted to the correcting section 14, the correction amounts Δθ1, Δθ2, ΔP which are outputted from the correcting section 14 depending on the type or kind of yarn, and by properly selecting the weft yarn Y for weft insertion.

As described above, an inventive weft insertion controlling method comprises the steps of: setting an upper limit and a lower limit with respect to running property of a weft yarn to be inserted through a shed of warp yarns by way of a main nozzle and a plurality of groups of sub nozzles arrayed in the running direction of the weft yarn; and causing air jet end timings of the respective groups of sub nozzles to become later when the running property of a weft yarn is lower than the lower limit, and air jet start timings of the respective groups of sub nozzles to become sooner when the running property of a weft yarn is higher than the upper limit.

The air jet end timings of the respective groups of sub nozzles are delayed when it is detected that the running property of a weft yarn is lower than the lower limit, whereas the air jet start timings of the respective groups of sub nozzles are advanced when it is detected that the running property of a weft yarn is higher than the upper limit. This method can adequately cope with variation in the weft yarn running property.

The running property of a weft yarn can be detected by monitoring, for instance, the weft arrival timing at which the tip end of the weft yarn at one picking operation reaches a predetermined position on the weft-out side of the loom. This is because determination result as to whether the running property of a weft yarn is higher or lower than a reference value of the running property of a weft yarn reflects a fact as to whether the detected weft arrival timing is earlier or later than a reference weft arrival timing. As the running property is higher, the weft arrival timing is advanced, whereas as the running property is lower, the weft arrival timing is delayed. In view of this, the upper limit and the lower limit with respect to the running property are set as the lower limit and the upper limit of the weft arrival timing, respectively.

Alternatively, the running property of weft yarn may be detected based on the weft arrival timing at which the tip end of weft yarn at one picking operation reaches a predetermined position of the running path of weft yarn, which is located sufficiently away from the main nozzle. Alternatively, the running property of a weft yarn may be detected based on a release completion timing at which the weft yarn of the length corresponding to one picking operation is released from the weft measuring and storing apparatus of the loom. The modification is proposed in view of the fact that determination result as to whether the running property of a weft yarn is higher or lower than a reference value of the running property of a weft yarn reflects a fact as to whether the weft arrival timing and the release completion timing are earlier or later than a reference weft arrival timing and a reference release completion timing, respectively.

Preferably, the method may be further provided with the steps of setting a backup lower limit which is lower than the lower limit with respect to the running property of a weft yarn, and a backup upper limit which is higher than the upper limit with respect to the running property of a weft yarn, and causing the air jet pressure of the main nozzle to become higher than a reference air jet pressure of the main nozzle when the running property of a weft yarn is lower than the backup lower limit, and the air jet pressure of the main nozzle to become lower than the reference air jet pressure of the main nozzle when the running property of a weft yarn is higher than the backup upper limit.

Regulating the air jet pressure of the main nozzle when it is detected that the running property is deviated from the backup lower limit and the backup upper limit is effective in coping with a condition that the running property is greatly varied. This is because lowering of the running property can be compensated for by increasing the air jet pressure of the main nozzle, and excessive rise of the running property can be suppressed by decreasing the air jet pressure of the main nozzle.

Preferably, the air jet orientations of the respective groups of sub nozzles may be correctively aligned in the identical direction one to another at the same timing of correcting the air jet pressure of the main nozzle.

Further, the changing of the air jet end timing and the air jet start timing may be preferably performed to the groups of sub nozzles except a most upstream group of sub nozzles in the running direction of the weft yarn. Generally, values for the air jet end timing and the air jet start timing of the most upstream group of sub nozzles are not greatly affected by variation of the running property of weft yarn. Therefore, the air consumption can be saved by allowing the most upstream group of sub nozzles to suspend its operation at the air jet end timing and the air jet start timing. Alternatively, one or more groups of sub nozzles including the most upstream group of sub nozzles may be allowed to suspend its or their operation at the air jet end timing and the air jet start timing.

This application is based on Japanese patent application No. 2002-212296 filed in Japan on Jul. 22, 2002, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A method for controlling weft insertion in an air jet type loom, comprising the steps of:

setting an upper limit and a lower limit with respect to running property of a weft yarn to be inserted through a shed of warp yarns by way of a main nozzle and a plurality of groups of sub nozzles arrayed in the running direction of the weft yarn; and causing air jet end timings of predetermined groups of sub nozzles to become later when the running property of a weft yarn is lower than the lower limit, and air jet start timings of predetermined groups of sub nozzles to become sooner when the running property of a weft yarn is higher than the upper limit.

2. The method according to claim 1, further comprising the steps of:

setting a backup lower limit which is lower than the lower limit with respect to the running property of a weft yarn, and a backup upper limit which is higher than the upper limit with respect to the running property of a weft yarn; and causing the air jet pressure of the main nozzle to become higher than a reference air jet pressure of the main nozzle when the running property of a weft yarn is lower than the backup lower limit, and the air jet pressure of the main nozzle to become lower than the reference air jet pressure of the main nozzle when the running property of a weft yarn is higher than the backup upper limit.

3. The method according to claim 2, wherein the predetermined groups of sub nozzles are those except a most upstream group of sub nozzles in the running direction of the weft yarn.

4. The method according to claim 1, wherein the predetermined groups of sub nozzles are those except a most upstream group of sub nozzles in the running direction of the weft yarn.

* * * * *